United States Patent [19]

Brügmann

[11] 4,209,925

[45] Jul. 1, 1980

[54] LABELING TAB FOR HANGING FOLDERS

[76] Inventor: Dirk A. Brügmann, Derkmannsstück 27, Ergste, Fed. Rep. of Germany, 5843

[21] Appl. No.: 871,939

[22] Filed: Jan. 24, 1978

[30] Foreign Application Priority Data

Nov. 18, 1977 [DE] Fed. Rep. of Germany ..... 2751683

[51] Int. Cl.[2] ..... B42F 21/00

[52] U.S. Cl. ..... 40/359; 40/23 A

[58] Field of Search ..... 40/23, 23 A, 359, 360, 40/16

[56] References Cited

U.S. PATENT DOCUMENTS

| | | | |
|---|---|---|---|
| 1,052,505 | 2/1913 | Munger et al. | 40/23 A |
| 1,742,277 | 1/1930 | Quigley | 40/23 A |
| 2,910,985 | 11/1959 | Epstein | 40/359 |

FOREIGN PATENT DOCUMENTS

| | | | |
|---|---|---|---|
| 934883 | 11/1955 | Fed. Rep. of Germany | 40/23 A |
| 1224270 | 9/1966 | Fed. Rep. of Germany | 40/360 |
| 2452296 | 4/1974 | Fed. Rep. of Germany | 40/359 |
| 536981 | 12/1955 | Italy | 40/23 A |
| 318547 | 12/1969 | Sweden | 40/359 |

*Primary Examiner*—Louis G. Mancene
*Assistant Examiner*—Wenceslao J. Contreras
*Attorney, Agent, or Firm*—Browdy & Neimark

[57] ABSTRACT

A plastic tab for labeling hanging files and folders provided with slots along the upper edges thereof, comprises a U-shaped label section, a flap extension section connected to the U-shaped label section and which abuts the outer face of one of the flaps, and a tongue extending from the flap extension section and inclined out of the plane thereof so as to engage the edge of a slot in the hanging folder.

6 Claims, 3 Drawing Figures

LABELING TAB FOR HANGING FOLDERS

FIELD OF THE INVENTION

This invention relates to plastic tabs for hanging folders, and, more particularly, to such tabs having a label section and for application to hanging files or folders provided with slots therein along one of the edges thereof.

BACKGROUND OF THE INVENTION

Hanging files or folders are widely used in all types of offices. These hanging folders are normally comprised of stiff, heavy paper folded and glued to form a lengthwise horizontal passageway along their upper edge(s) through which is passed a metallic hanger rod having suitable hanging hooks at its ends for suspension in a filing cabinet or the like. Vertical slots are normally provided along such upper edge(s) of the folders through which the hanger rod can be seen. Tabs previously available for labeling these hanging folders do not combine simplicity of installation, ease in manufacturing and hence sufficiently low cost, and the ability to be used as a handle or gripping means for handling such hanging folders.

BRIEF SUMMARY OF THE INVENTION

It is accordingly an object of the present invention to overcome deficiencies in the prior art, such as indicated above.

It is another object to provide for improved handling of hanging folders.

It is another object to provide a plastic tab for hanging folders which can also be used as a means for handling hanging folders.

It is another object of the present invention to provide a plastic tab for hanging folders which can be easily and reliably installed.

It is a further object of the present invention to provide a plastic tab for hanging folders which is easily and inexpensively manufactured.

These objectives are achieved by providing a tab, preferably formed of extruded plastic, and having a flap portion which, in use, overlaps the upper edge of the folder having the vertical slots therein, the flap portion having a tongue which is insertable in at least one of the slots. A tab of this kind is easy to handle. It can be placed over the edge of the folder and then displaced lengthwise until the tongue enters the desired slot of the hanging file or folder, thereby providing the desired label.

The design of this tab is such that it can be manufactured in a very simple and inexpensive manner from a segment of an extruded plastic profile. In order further to simplify and reduce the cost of manufacture, the tongue can be stamped out of the flap portion in such manner that it is inclined out of the plane of the flap portion relative to the slot.

The tongue can have two side edges and a leading edge, whereby the upper side edge of the tongue i.e. that edge which faces the label bearing portion of the tab for facilitating introduction of the tongue into the slot, extends parallel to the edge of the folder when the tongue has been inserted into the slot. In order to further facilitate insertion of the tongue into the slot, the leading edge of the tongue can be made sloping between the side edges thereof. Also in order to make it easier to introduce the leading edge of the tongue into the slot, an inwardly deflected nose can be provided thereon, such that it is directed approximately parallel to the plane of the flap portion, whereby this nose advantageously links the bottom side edge of the tongue, i.e. that edge facing away from the label bearing section, with the sloping leading edge.

The label bearing section of the tab, i.e. that section of the tab into which a label cutout is inserted, can be provided with a retaining flange located at a distance from the flap portion and running parallel thereto. This design is advantageous because the flap portion and the retaining flange can fit around the upper edge of the hanging file through which the hanger rod extends, thus ensuring a good seat for the label and helping to anchor the tab in place.

The label bearing portion can be U-shaped in cross section and an inwardly extending label holding flange can be provided on the U-shaped profile of the label bearing section along its terminal edge. This holding flange serves to hold an information label insertable in the U-shaped profile of the label bearing section.

In an advantageous embodiment, two tongues, displaced relative to one another at a distance equal to the spacings of the vertical slots along the upper edge of the folder, are provided, such tongues being especially advantageous when a separate retaining flange is not provided.

In general, the tongue is designed and arranged so that its nose is located beneath the hanger rod when such tongue has been inserted into the vertical slot, so that such tongue can be easily slid into such slot. However, the design can be such that the hanger rod itself has a recess to accept such nose, in which case the nose may be located somewhat closer to the edge of the folder.

An exemplary embodiment of the invention is described hereinbelow with reference to the drawing.

DETAILED DESCRIPTION OF A PREFERRED EMBODIMENT

Figure 1:
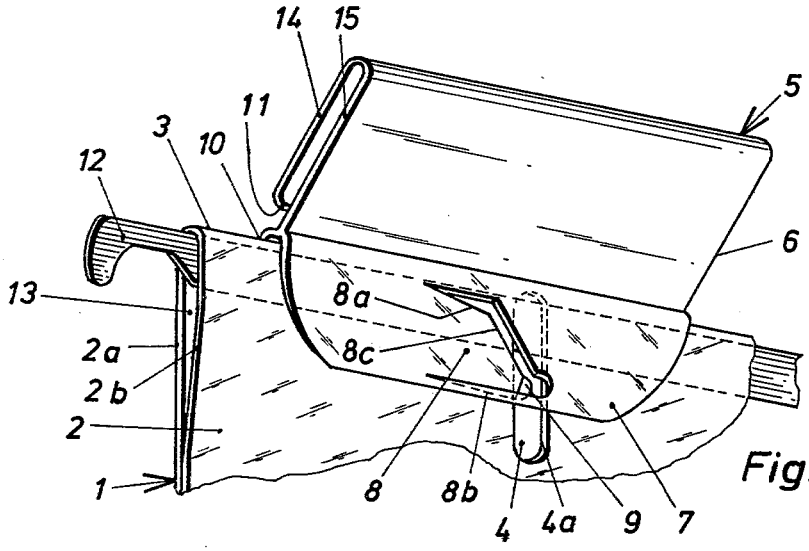
FIG. 1 is a schematic perspective view of a tab mounted over the edge of a typical hanging folder, whereby the tongue has not yet been slid into the slot.

In FIG. 1, a portion of a hanging folder 1 or a hanging file is shown schematically. Known hanging files of this type are folded over to provide two flaps 2*a* and 2*b* defining therebetween a passageway or tube 13. Vertical slots such as at 4, are provided on the upper edge or on the lateral edges of the flap 2*b*, such slots 4 serving to hold tabs or hangers. In the embodiment shown in FIG. 1, the folded over flap 2 defining the lengthwise horizontal passageway 13 and an upper edge 3 accepts therethrough a hanger rod 12. It should be noted that a design of this kind for the flap 2 of the folder 1 is not crucial to the proper functioning of the present invention.

A tab 5, preferably of plastic, is placed on the edge 3 of the flap 2 and must be fixed in a certain longitudinal position along the edge 3. To immobilize the tab 5, the slot 4, provided in the vicinity of the edge 3 of the flap 2, in the folded-over flap section 2*b*, is made use of. In other embodiments, many such slots are provided along flap 2 in the vicinity of edge 3.

The tab 5 is provided with a label bearing section 6 which is U-shaped in cross section having legs 14 and 15. The outer leg 14 has a label holding flange 11 which extends inwardly. Cards or paper strips having information thereon, for example, can be inserted between legs 14 and 15, and are held in place by the label holding flange 11.

A flap portion 7 is attached to and completely abuts label section 6; these are preferably integrally formed. As can be readily seen in the figures, the flap portion 7 overlaps the inside of edge 3 lying adjacent flap 2*b* of the folder 1. A tongue 8 is provided on the flap portion 7, such tongue 8 being capable of being inserted into the slot 4 to lock the tab 5 in position. Tab 5 can be simply placed next to the desired slot over the edge 3 of the flap 2, and then displaced lengthwise along the edge 3 so that the tongue 8 is introduced into the slot 4.

The tongue 8 has two side edges 8*a* and 8*b*, and a leading edge 8*c*. In order for the tongue 8 to be guided reliably under the rear longitudinal edge 4*a* of the slot 4 to securely lock the tab 5 to the hanging folder 1, the upper side edge 8*a* of the tongue 8 is made parallel to the edge 3 of the hanging folder 1. In order to facilitate the introduction of the tongue 8 into the slot 4, the leading edge 8*c* thereof is made sloping between side edges 8*a* and 8*b*. As FIG. 1 shows, the slope is such that the side edge 8*a* forms an obtuse angle with the leading edge 8*c* and side edge 8*b* forms an acute angle with leading edge 8*c*.

In order to further facilitate the insertion of the tongue 8, an inwardly curved nose 9 is provided on leading edge 8*c* thereof. Preferably, this nose 9 connects the bottom side edge 8*b* of tongue 8, which faces away from label carrying section 6, with the leading edge 8*c*. The inwardly directed curvature of nose 9 is clearly visible in FIG. 3. When mounting the tab 5 on the flap 2, the nose 9 is placed against the outside of the flap section 2*b* and when the tab 5 is displaced toward the slot 4, the nose 9, upon reaching the slot 4, automatically enters said slot and can then lock beneath its edge 4*a*. Thus, the tongue 8 is positively introduced into slot 4, so that the tongue 8 finally reaches the position shown in FIGS. 2 and 3. If no tube 13 and no hanger rod 12 are provided, the position of the tongue 8 is not critical. However, if a hanger rod 12 is provided, the tongue 8 is designed and positioned in such a manner that tongue 8, as shown in FIG. 1, is located beneath the hanger rod 12 when the tab 5 is inserted into the slot; or inside hanger rod 12, as viewed from edge 3.

If the folder has a hanger rod 12, it can be provided with a recess or a slot which serves to accept the tongue 8, so that the tongue can fit unimpeded beneath the rear edge 4*a* of slot 4. With this type of hanger rod 12, the positioning of the nose 9 may be modified.

Figure 2:
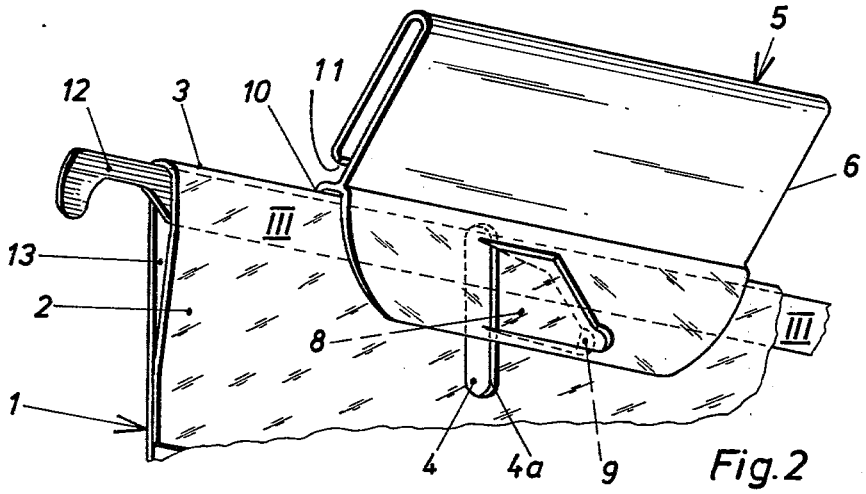
FIG. 2 is a schematic perspective view corresponding to FIG. 1 wherein the tongue has been inserted into the slot.
Figure 3:
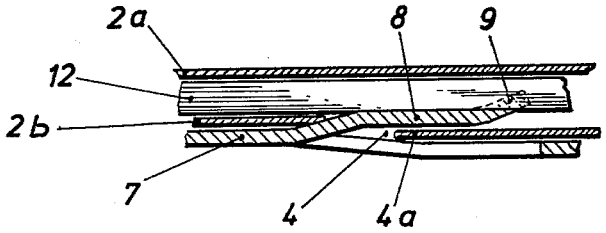
FIG. 3 is a cross section along line III—III in FIG. 2.

As shown in FIGS. 1 and 2, the label carrying section 6 is also provided with a retaining flange 10, said flange 10 running parallel to the flap portion 7 and at a distance therefrom. When the tab 5 is attached to the folder 1, the retaining flange 10 rests on the outer section 2*a* of the flap 2. The retaining flange 10 and flap portion 7 form a forked section which accepts the edge 3 therebetween. It should be noted that if desired this retaining flange 10 can be eliminated.

The tab 5 is preferably made from a transparent plastic having sufficient elasticity to exert a restoring force. The profile of this tab 5 is such that it can be made from an extruded plastic shape, the tabs 5 then being formed by stamping or cutting from the extrudate. Thus, it is merely necessary to cut into the extruded profile and then, by stamping and pressing if necessary, shape the tongue 8 out of the flap portion 7, thereby forming the tongue 8 and its nose 9 in the shape best shown in FIG. 3.

This design for the tab 5 reduces the manufacturing costs considerably, which is of great importance for mass production. Furthermore, tongue 8, especially because it is guided by its upper side edge 8*a*, fits deep behind section 2*b* of the flap 2, thus ensuring a good seat for the tab 5. This seat for the tab 5 is such that it enables the tab to be used simultaneously as a handle means, by which, for example, a hanging folder can be lifted out of an appropriate file drawer.

In another advantageous embodiment, two tongues, displaced relative to one another, are inserted into two different slots, said tongues being especially advantageous when a separate retaining flange 10 is not provided.

It will be obvious to those skilled in the art that various changes may be made without departing from the scope of the invention, and the invention is not to be considered limited to what is shown in the drawings and described in the specification.

What is claimed is:

1. A plastic tab for a hanging folder with an upper edge and at least one slot in a flap of the hanging folder, comprising:

a label carrying means for labeling the hanging folder and adapted to project beyond the upper edge of the folder;

a flap portion attached to said label carrying means for slidably contacting a face of the hanging folder, said flap portion having an inside face and extending along a given plane;

a single tongue stamped out of said flap portion and integral therewith, said tongue extending away from said inside face, out of said given plane of said flap portion for inserting into a slot in a hanging folder, such that when said tongue is inserted into the slot in the hanging folder said tongue extends toward and through the slot, said tab and the hanging folder are locked together and the hanging folder can be handcarried by grasping said tab, wherein said single tongue has an upper edge, a leading edge and a bottom edge, said upper edge when the tab is in place being parallel to the upper edge of the hanging folder, said leading edge being disposed from said upper edge such than an obtuse angle is formed therebetween, said leading edge being diposed from said bottom edge such that an acute angle is formed therebetween.

2. A plastic tab for a hanging folder with at least one slot therein according to claim 1, wherein said single tongue includes a nose for facilitating the insertion of said tongue into the slot of the hanging folder, said nose connecting said bottom edge of said tongue with said leading edge of said tongue, and said nose being curved inwardly with respect to the general plane of said tongue.

3. A plastic tab for a hanging folder with at least one slot therein according to claim 2, wherein said label carrying means comprises:

a U-shaped section with inner and outer legs, said inner leg being closer than said outer leg to said hanging folder and for mounting information cards or strips therebetween; and an inwardly extending label holding flange connected to the end of said outer leg of said U-shaped section and running the length thereof.

4. A plastic tab for a hanging folder with at least one slot in a flap thereof according to claim 3, wherein said label carrying means further comprises:

a retaining flange extending from the end of the inner leg of said U-shaped section and running the length thereof, said retaining flange extending generally parallel to said flap portion and spaced therefrom so as to form a forked section with said flap portion for the receipt therebetween of the top edge of the hanging folder.

5. A plastic tab for a hanging folder with at least one slot therein according to claim 1, wherein said plastic tab is composed of transparent plastic which exerts a restoring force when deformed.

6. In a hanging folder having a lengthwise tube at the upper edge thereof through which passes a hanger rod, and at least one vertical slot near the upper edge and extending into the lengthwise tube, the improvement consisting:

a label carrying means for labeling said hanging folder and projecting upwardly beyond said upper edge;

a flap portion attached to said label carrying means and contacting a face of said hanging folder adjacent said upper edge, said flap portion having an inside face and extending along a given plane;

a single tongue stamped out of said flap portion and integral therewith attached to said flap portion on said inside face thereof and extending away from said inside face, out of said given plane of said flap portion, towards and into said vertical slot in said hanging folder, such that said tab and said hanging folder are locked together, and wherein said hanging folder can be hand-carried by grasping said tab;

said tongue having a top edge, a leading edge and a bottom edge, said top edge being parallel to said upper edge of said hanging folder, said leading edge being disposed from said top edge by an obtuse angle, and said leading edge being disposed from said bottom edge by an acute angle; and a nose to facilitate the insertion of said tongue into said vertical slot of said hanging folder, said nose connecting said leading edge of said tongue with said bottom edge thereof and being curved inwardly with respect to the general plane of said tongue and inserted into said slot of said hanging folder, said nose being located beneath the hanger rod.

* * * * *